US010971802B2

(12) United States Patent
Kim et al.

(10) Patent No.: US 10,971,802 B2
(45) Date of Patent: Apr. 6, 2021

(54) MULTIBAND BASE STATION ANTENNA

(71) Applicant: GAMMA NU, INC., Hwaseong-si (KR)

(72) Inventors: Sang Gi Kim, Hwaseong-si (KR); Sang Jin Kim, Hwaseong-si (KR); Hong Ki Choi, Hwaseong-si (KR); Sinelnikov Yury, Hwaseong-si (KR); Kyoung Sub Oh, Hwaseong-si (KR)

(73) Assignee: GAMMA NU, INC., Hwaseong-si (KR)

( * ) Notice: Subject to any disclaimer, the term of this patent is extended or adjusted under 35 U.S.C. 154(b) by 0 days.

(21) Appl. No.: 16/492,290

(22) PCT Filed: Aug. 25, 2017

(86) PCT No.: PCT/KR2017/009338
§ 371 (c)(1),
(2) Date: Sep. 9, 2019

(87) PCT Pub. No.: WO2018/182109
PCT Pub. Date: Oct. 4, 2018

(65) Prior Publication Data

US 2020/0014097 A1 Jan. 9, 2020

(30) Foreign Application Priority Data

Mar. 31, 2017 (KR) ..... 10-2017-0041894

(51) Int. Cl.
*H01Q 1/24* (2006.01)
*H01Q 15/14* (2006.01)
(Continued)

(52) U.S. Cl.
CPC ..... *H01Q 1/246* (2013.01); *H01Q 5/00* (2013.01); *H01Q 5/30* (2015.01); *H01Q 5/378* (2015.01);
(Continued)

(58) Field of Classification Search
CPC ..... H01Q 1/246; H01Q 5/378; H01Q 15/14; H01Q 9/16; H01Q 21/26; H01Q 5/42;
(Continued)

(56) References Cited

U.S. PATENT DOCUMENTS 10,148,012 B2 * 12/2018 Wu ..... H01Q 5/49
10,483,635 B2 * 11/2019 Yu ..... H01Q 15/14
(Continued)

FOREIGN PATENT DOCUMENTS

JP 09153725 A 6/1997
JP 2007159064 A 6/2007
(Continued)

OTHER PUBLICATIONS

Base station antenna, YurySinelnikov et al. , (KR10-1644445B1 English Machine Translation) Published Jan. 8, 2016.*

*Primary Examiner* — Vibol Tan
(74) *Attorney, Agent, or Firm* — Browdy and Neimark, P.L.L.C.

(57) ABSTRACT

The present invention relates to a base station antenna comprising: a reflective plate; at least one first band radiation element positioned on the upper surface of the reflective plate, including a first power feed unit, and having a first wavelength ($\lambda_H$); and at least one second band radiation element positioned on the upper surface of the reflective plate, including a second power feed unit, and having a second wavelength ($\lambda_L$), wherein the first power feed unit is connected to a power feed line on the lower surface of the reflective plate, and the power feed line is shorted with the reflective plate at a short point spaced apart at a preset interval from the first band radiation element.

7 Claims, 8 Drawing Sheets

(51) Int. Cl.

| | |
|---|---|
| ***H01Q 5/378*** | (2015.01) |
| ***H01Q 5/30*** | (2015.01) |
| ***H01Q 5/00*** | (2015.01) |
| *H01Q 9/16* | (2006.01) |
| *H01Q 21/26* | (2006.01) |

(52) U.S. Cl.
CPC ..... *H01Q 15/14* (2013.01); *H01Q 9/16* (2013.01); *H01Q 21/26* (2013.01)

(58) Field of Classification Search
CPC .. H01Q 21/0075; H01Q 5/48; H01Q 21/0006; H01Q 5/00; H01Q 19/10; H01Q 1/521; H01Q 5/30; H01Q 9/0421
See application file for complete search history.

(56) References Cited

U.S. PATENT DOCUMENTS

| | | | | |
|---|---|---|---|---|
| 10,601,120 | B2 * | 3/2020 | Bisiules | H01Q 1/42 |
| 10,790,576 | B2 * | 9/2020 | Buondelmonte | H01Q 1/246 |
| 2014/0139387 | A1 | 5/2014 | Jones et al. | |

FOREIGN PATENT DOCUMENTS

| | | | |
|---|---|---|---|
| KR | 100454142 | B1 | 10/2004 |
| KR | 10107792 | B1 | 10/2011 |
| KR | 101644445 | B1 | 8/2016 |

* cited by examiner

MULTIBAND BASE STATION ANTENNA

TECHNICAL FIELD

The present invention relates to a multiband base station antenna including a low frequency band radiation element and a high frequency band radiation element on a reflective plate, in which a power feed line is shorted with the reflective plate at a short point spaced apart from the power feed line for feeding the high frequency band radiation element by a preset distance to reduce interference between the two radiation elements so that isolation, performance of a voltage standing wave ratio (VSWR), and a pattern of the low frequency band radiation element are prevented from being distorted.

BACKGROUND ART

In multiband base station antennas, dual band antennas for wireless and cellular voice/data communications are generally used. Such a dual band base station antenna (BTS) operates in a low frequency band (824 MHz to 960 MHz) and a high frequency band (1710 MHz to 2170 MHz), and a global system for mobile communications (GSM), a universal mobile telecommunications system (UMTS), personal communications service (PCS), wideband code division multiple access (WCDMA) third generation (3G) services, and the like may be provided through the dual band base station antenna.

However, a long-term evolution (LTE) fourth generation (4G) wireless communication system, which is rapidly spreading recently, operates in 44 frequency bands between 698 MHz and 3800 MHz, and users of an LTE mobile system may use multiple bands in the same area. Therefore, although conventional dual band antennas have been widely used due to the usefulness thereof, there has been a problem that the conventional dual band antennas are not sufficient to be applied to the LTE 4G wireless system that requires multiband characteristics.

In addition, the LTE system uses multiple input/multiple output communication technologies that require multi-input multi-output (MIMO) antennas. In this case, there is an increasing demand for the configuration of dual band base station antennas which are arranged in two or three columns and operating in a low frequency band of 698 MHz to 960 MHz and a high frequency band of 1710 MHz to 2690 MHz where LTE frequencies exist.

Referring to representative techniques generally known in the art, the configuration of a base station antenna disclosed in United States Patent Application Publication No. 2014-0139387 is shown in FIG. 1A. In this case, when forming a base station antenna that supports a multi-frequency band by using generally used radiation elements, high frequency band radiation elements 450, 452, 454, and 456 and low frequency band radiation elements 140B and 120B are used together in the base station antenna. However, when the high frequency band radiation elements and the low frequency band radiation elements are arranged in columns while being adjacent to each other at a predetermined interval, a resonance phenomenon occurs between the radiation elements operating in both bands so that the high frequency band radiation element may distort a pattern and VSWR characteristics of the low frequency band radiation element and may severely degrade a value of polarization isolation of the low frequency band radiation element.

DETAILED DESCRIPTION OF THE INVENTION

Technical Problem

An object of the present invention is to provide a multiband base station antenna that maintains a high level of electrical characteristics by a novel LTE 4G wireless communication system. To this end, a short point is spaced apart from a power feed line for feeding a high frequency band radiation element by a preset distance.

The technical problem to be solved by the present invention is not limited to the technical problem mentioned above, and various technical problems may be included within the scope apparent to those skilled in the art from the following description.

Technical Solution

A base station antenna includes: a reflective plate; at least one first band radiation element disposed on a top surface of the reflective plate and having a first wavelength ($\lambda_H$); and at least one second band radiation element disposed on the top surface of the reflective plate and having a second wavelength ($\lambda_L$), wherein the first band radiation element is not directly connected to the reflective plate, the first band radiation element includes a first band radiation element support, a support lower end of the first band radiation element is connected to a power feed line on the reflective plate, and the power feed line is shorted with the reflective plate at a short point spaced apart from the first band radiation element by a preset interval.

In addition, in the base station antenna according to one embodiment of the present invention, the short point may be spaced apart from a distal end of a radiator of the first band radiation element by ¼ of the second wavelength. In addition, in the base station antenna according to one embodiment of the present invention, the short point length (LS) may be represented by $L_S=\lambda_L/4-L1/2-H1$ (L1: radiator length, H1: height of the first band radiation element support). In addition, in the base station antenna according to one embodiment of the present invention, the power feed line may include a coaxial cable or a transmission line on a PCB substrate. In addition, in the base station antenna according to one embodiment of the present invention, when the power feed line includes the coaxial cable, an outer conductor of the coaxial cable may make contact with the reflective plate at the short point. In addition, the base station antenna according to one embodiment of the present invention may further include a first dielectric disposed between the first band radiation element and the reflective plate to prevent the reflective plate from making direct electrical contact with the first band radiation element. In addition, the first band radiation element of the second band radiation element may include: a radiator; and a support extending from a center of the radiator in a direction perpendicular to the radiator, wherein the radiator may include: a first arm which extends while being curved at a specific angle, has a groove formed from one end to an opposite end of the first arm, and includes a protrusion protruding from the one end and the opposite end of the first arm; and a second arm facing the first arm.

A base station antenna includes: one or more first band radiation elements arranged in two columns; and one or more second band radiation elements arranged in one column which is disposed between the two columns.

Advantageous Effects of the Invention

According to the present invention, in the multiband base station antenna including two broadband radiation elements, which are a low frequency band radiation element and a high frequency band radiation element, the power feed line is shorted with the reflective plate at the short point spaced apart from the power feed line for feeding the radiation element by a preset distance to reduce the interference between the two radiation elements so that the isolation, the performance of the VSWR, and the pattern of the low frequency band radiation element can be prevented from being distorted, and thus antenna performance can be improved.

Figure 1A:
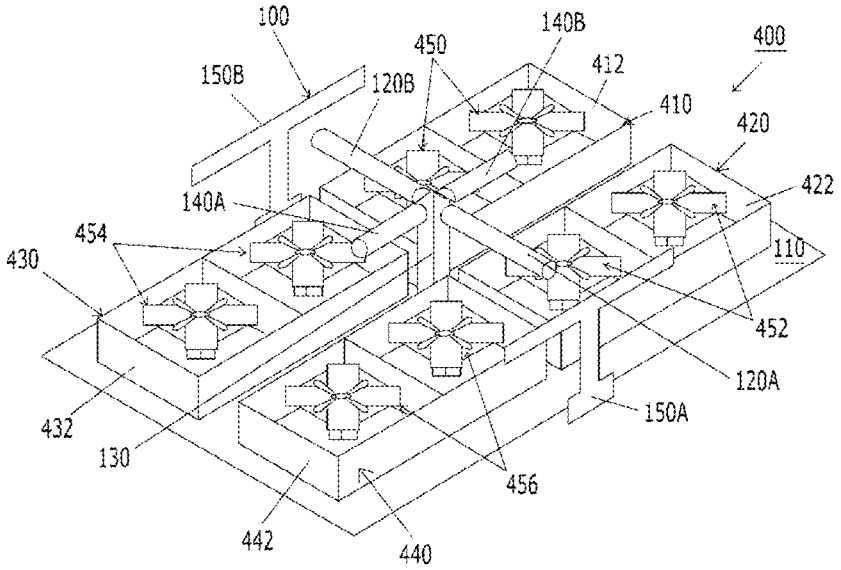
FIG. 1A PRIOR ART
FIG. 1A is a view illustrating a base station antenna of the related art.

Meanwhile, the reference numerals used in the drawings are as follows.

10, 11, 13: Dipole antenna
20: Reflective plate
110: Reflective plate
120: First band radiation element
121: First band radiation element radiator
122: First band radiation element support
123: Support lower end of first band radiation element
124: Dielectric
130: Second band radiation element
140: Power feed line
141: +45 Degree signal line
142: −45 Degree signal line
143: Coaxial cable
144: Microstrip line
145: Substrate
150: Short part
151: Short point length
152: Radiator length/2
153: Height of first band radiation element support
160: Substrate
161, 162: Signal line
155: +45 Degree signal line
156: −45 Degree signal line
171: First arm
172: Groove
173: Protrusion
174: Support
175: Current path
176: Second arm
177: Third arm
178: Fourth Arm
180: Support
181: Hole
182: Concavo-convex part
183: Droop
184: Fifth arm
185: Sixth arm
186: Seventh arm
187: Eighth arm
188: Current path

BEST MODE

Hereinafter, a 'multiband base station antenna' according to the present invention will be described in detail with reference to the accompanying drawings. The following embodiments are provided so that those skilled in the art may easily understand the technical idea of the present invention, and thus the present invention is not limited to the embodiments. In addition, the components shown in the accompanying drawings may be schematically expressed in order to easily explain the embodiments of the present invention, and may be different from the actual implementation thereof.

Meanwhile, each constituent portion that will be described below is only an example for implementing the present invention. Thus, other constituent portions may be used in other implementations of the present invention without departing from the spirit and scope of the present invention.

In addition, the term "comprising" is an 'open-type' term that only refers to the presence of the components, and shall not be understood to preclude the presence of additional components.

Further, terms such as "first" and "second" are used only for discriminating a plurality of components from one another, and does not limit an order or other features of the components.

In the description of the embodiments, when a layer (or film), a region, a pattern, or a structure is referred to as being "on" or "under" another substrate, another layer (or film), another region, another pad, or another pattern, it may be "directly" formed on/under the other substrate, layer (or film), region, pad, or patter, or other intervening layers may be present. Such a position of the layer such as "on" or "under" will be determined based on the drawings.

When a part is referred to as being "connected" to another part, it may be "directly connected" or "indirectly connected" to another part with other members interposed therebetween. In addition, when a part is referred to as "including" an element, unless explicitly described to the contrary, it means that other elements may be further included but not excluded.

Figure 1B:
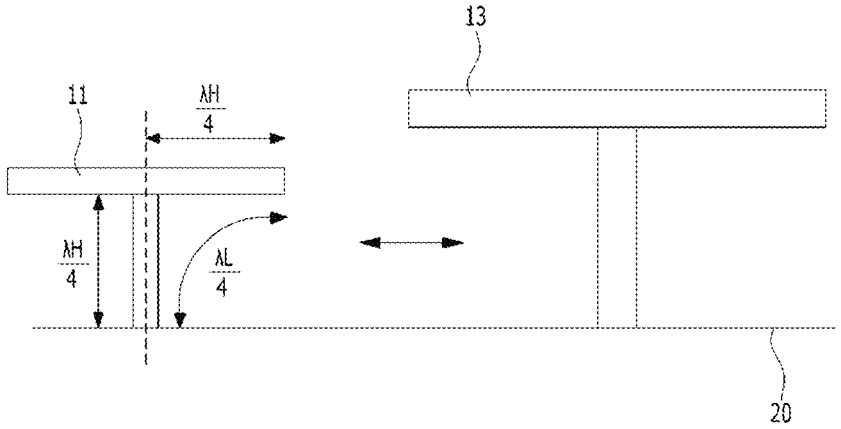
FIG. 1B PRIOR ART
FIG. 1B is a view illustrating resonance, interference, and mutual coupling that occur by the base station antenna of the related art.

FIG. 1A is a view illustrating a base station antenna of the related art, and FIG. 1B is a view illustrating resonance, interference, and mutual coupling that occur by the base station antenna of the related art.

Referring to FIG. 1A, the configuration of a base station antenna disclosed in United States Patent Application Publication No. 2014-0139387 is shown. In this case, when forming a base station antenna that supports a multi-frequency band by using generally used radiation elements, high frequency band radiation elements 450, 452, 454, and 456 and low frequency band radiation elements 120B and 140B are used together in the base station antenna.

Referring to FIG. 1B, when providing dipole antennas 11 and 13 on a reflective plate 20, a high frequency band dipole antenna 11 and a low frequency band dipole antenna 13 may be provided on the reflective plate at a predetermined interval. In this case, resonance may occur between the high frequency band dipole antenna 11 and the low frequency band dipole antenna 13 so that radio waves of the same frequency may be returned by the high frequency band dipole antenna due to the resonance.

In particular, the high frequency band dipole antenna 11 generally has a height corresponding to ¼ wavelength and a dipole length corresponding to ¼ wavelength. However, when a total distance from a support to a radiator of the high frequency band dipole antenna is similar to ¼ wavelength of the low frequency band dipole antenna 13, interference and resonance may occur between the two antennas. The high frequency band dipole antenna substantially provides the same effects as a monopole antenna corresponding to ½ wavelength of the low frequency band dipole antenna 13, and the resonance is maximized at ½ wavelength of the dipole antenna, so that a resonance phenomenon may occur between the low frequency band dipole antenna and the high frequency band dipole antenna.

Therefore, resonance, interference, mutual coupling, or the like, which generates distortion causing a pattern to be widened or narrowed between the high frequency band dipole antenna 11 and the low frequency band dipole antenna 13, may be generated, thereby degrading the performance of frequency transmission/reception characteristics of the radiation elements.

Thus, in order to improve the above problem, the configuration of preventing the high frequency band radiation element from making direct contact with the reflective plate is further provided, so that a resonance frequency generating band may be shifted so as not to overlap an actual operating band of the low frequency band radiation element. This is based on the principle of shifting a resonance frequency by adding L and C components when the monopole antenna is fed. The detailed description thereof will be described below with reference to FIGS. 2 to 6.

Figure 2:
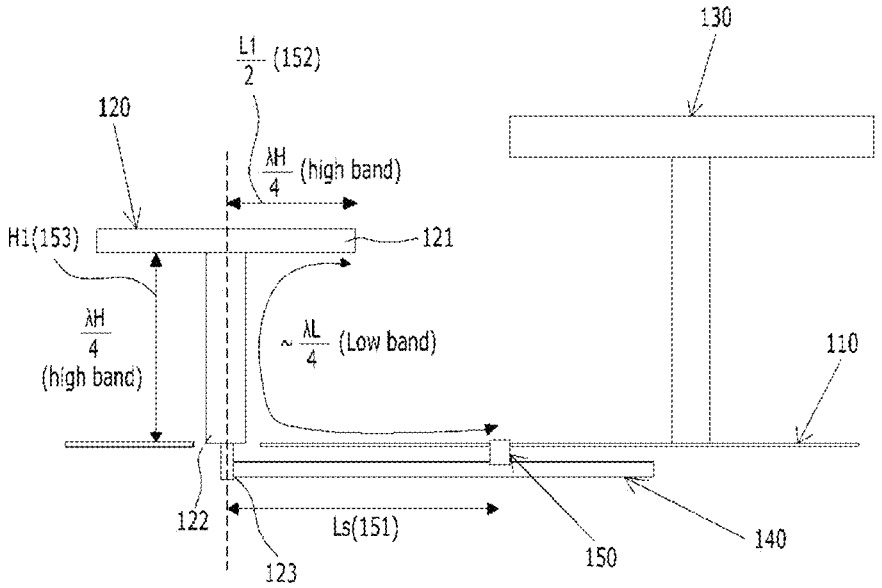
FIGS. 2, 3, and 4 are views illustrating the configuration of a band radiation element included in a base station antenna of the present invention.

FIG. 2 is a view illustrating the configuration of a band radiation element included in a base station antenna of the present invention.

Referring to FIG. 2, the base station antenna of the present invention may include a reflective plate 110, at least one first band radiation element 120 disposed on a top surface of the reflective plate and having a first wavelength $\lambda_H$, at least one second band radiation element 130 disposed on the top surface of the reflective plate and having a second wavelength $\lambda_L$, and a power feed line 140.

The first band radiation element 120 and the second band radiation element 130 are dipole radiation elements.

The dipole radiation element may include a radiator 121 and a support 122 extending in a direction perpendicular to the radiator 121.

The first band radiation element is not directly connected to the reflective plate 110, the first band radiation element 120 includes a first band radiation element support 122, a support lower end 123 of the first band radiation element is connected to a power feed line 140 on the reflective plate 110, and the power feed line 140 is shorted with the reflective plate at a short point spaced apart from the first band radiation element 120 by a preset interval.

The lower end 123 of the first band radiation element is electrically connected to the power feed line 140. As shown in FIG. 2, the first band radiation element is not directly connected to the reflective plate 110. The first band radiation element is connected to the reflective plate via the power feed line 140 and a short part 150. The point where the short part 150 is located is the short point.

When a frequency of a low frequency band is applied to the second band radiation element 130, the second band radiation element 130 radiates radio waves into the air. When the radio waves meet the first band radiation element 120 which is a conductor, a current is induced in the first band radiation element 120. The current flows on a surface of the first band radiation element 120 and flows to the short part 150 via the power feed line 140.

As the current flows as described above, the first band radiation element 120 emits radio waves having the frequency of the low frequency band, and the radio waves may generate a resonance phenomenon having a large energy.

The frequency band of the second band radiation element 130 is 698 MHz to 960 MHz (low frequency band), and the frequency band of the first band radiation element 120 is 1710 MHz to 2690 MHz (high frequency band).

When a length from the first band radiation element 120 to the point at which the first band radiation element 120 is shorted with the reflective plate 110 is about $\lambda_L/4$ of the second band radiation element, common mode resonance may occur in the first band radiation element 120. $\lambda_L$ is a wavelength of the second band radiation element.

In this case, a pattern of the second band radiation element may be severely distorted, and isolation and VSWR performance may be degraded. In order to avoid such resonance, the length of the first band radiation element 120 may be tuned to prevent the resonance from occurring in the frequency band of the second band radiation element 130, so that a distortion phenomenon may be removed.

In order to improve the performance degradation of the second band radiation element 130, the first band radiation element 120 is opened using a dielectric so as not to be short from the reflective plate 110, the support lower end 123 of the first band radiation element 120 passes through the reflective plate so as to be fed by a coaxial cable, the reflective plate 110 and an outer conductor of the coaxial cable are shorted at one point of the coaxial cable, so that the common mode resonance occurring in the first band radiation element may not occur in the band of interest.

The location of the short point may be set to adjust the length so that the common mode resonance occurring in the first band radiation element 120 does not occur within the frequency band of interest. In more detail, the short point may be set such that the length is longer than $\lambda_L/4$ at the lowest frequency within the frequency band of the second band radiation element.

In other words, a length of the power feed line that determines the short point has to be set such that the sum of a half of the length of the first band radiation element (L1/2), a height H1 of the first band radiation element support, and the length of the power feed line is longer than $\lambda_L/4$ at the minimum frequency of the second band radiation element.

In this case, the length is an electrical length corresponding to the length of a path through which the current flows rather than an actual length. Therefore, a distance Ls from the center of the radiation element to a portion of the coaxial cable which is to be shorted is represented as follows.

Ls (Short point length)=$\lambda_L/4-L1/2-H1$

Ls: Length from the center of the first band radiation element to the short point of the cable $\lambda_L$: Wavelength of the second band radiation element $L_1$: Length of the radiator 121 of the first band radiation element H1: Height of the first band radiation element support: Length from one end to an opposite end of the support In addition, the power feed line may include a coaxial cable or a transmission line on a substrate. In this case, when the power feed line includes the coaxial cable, an outer conductor of the coaxial cable may make contact with the reflective plate at the short point.

The short part protruding from the reflective plate may be shorted with the power feed line at the short point, and the short part may include a conductor. In other words, the short part 150 shown in FIG. 2 is shorted with the power feed line 140, and the short part 150 is a conductor.

Figure 3:
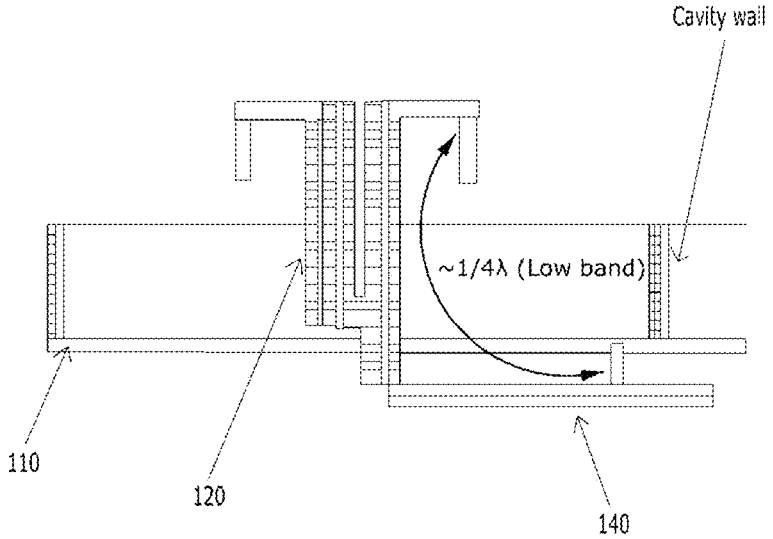

FIG. 3 is a view illustrating the configuration of the band radiation element included in the base station antenna of the present invention. A cavity wall shown in FIG. 3 is a conductor wall. The detailed descriptions of the first band radiation element 120, the reflective plate 110, and the power feed line 140 have been given above.

Figure 4:
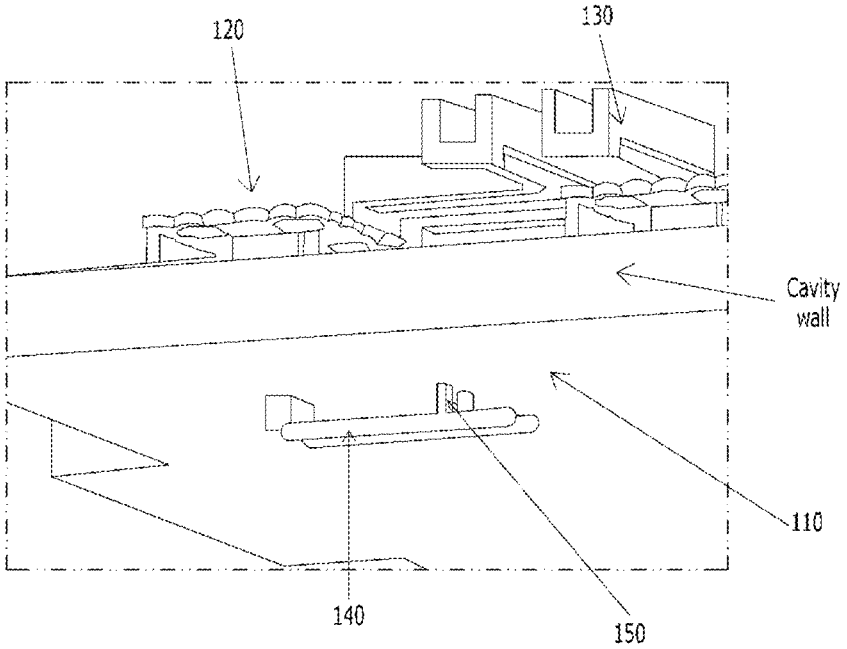

FIG. 4 is a view illustrating the configuration of the band radiation element included in the base station antenna of the present invention. Based on FIG. 4, the first band radiation element 120 and the second band radiation element 130 are disposed on a front surface of the reflective plate 110, and the support lower end of the first band radiation element 120 passes through the reflective plate 110. The power feed line 140 and the short part 150 may be disposed on a rear surface of the reflective plate 110.

FIGS. 5A to 5D are views illustrating the configuration in which the band radiation element included in the base station antenna of the present invention is shorted at a point spaced apart by a predetermined interval.

Figure 5A:
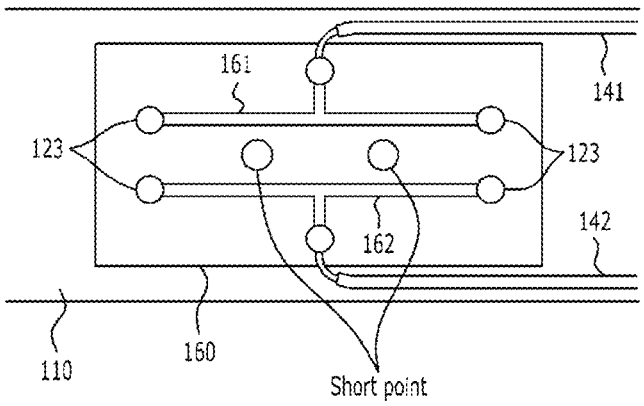
FIGS. 5A to 5D are views illustrating the configuration in which the band radiation element included in the base station antenna of the present invention is shorted at a point spaced apart by a predetermined interval.

FIG. 5A shows an embodiment where the power feed line includes the transmission line on a PCB substrate 160. A +45 degree signal line 141 may be connected to a signal line 161. A −45 degree signal line 142 may be connected to a signal line 162. A bottom surface of the PCB substrate 160 may be a ground plate, a signal line may be provided on a top surface of the PCB substrate 160, and a dielectric layer may be provided between the surface where the signal line is provided and the ground plate. As shown in FIG. 5A, the short point may exist between the two signal lines 161 and 162.

Figure 5B:
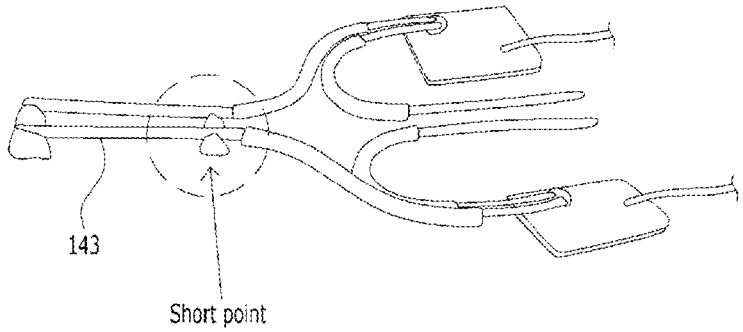

FIG. 5B shows the coaxial cable 143.

FIG. 5B shows that when the power feed line includes the coaxial cable, the outer conductor of the coaxial cable may make contact with the reflective place at the short point.

Figure 5C:
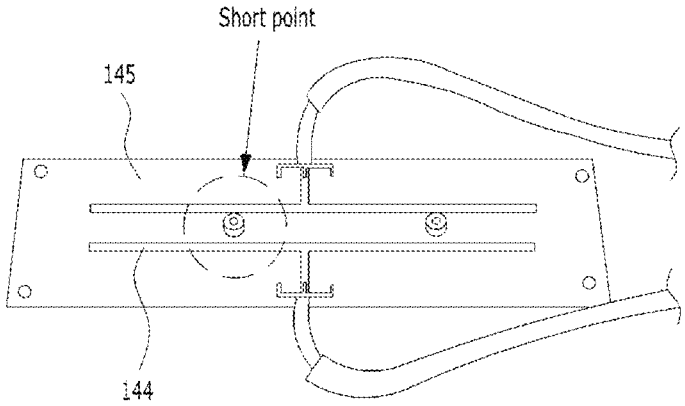

FIG. 5C shows a dielectric substrate 145 and a transmission line 144 on the substrate. The transmission line 144 may include a microstrip line, a strip line, and the like.

Figure 5D:
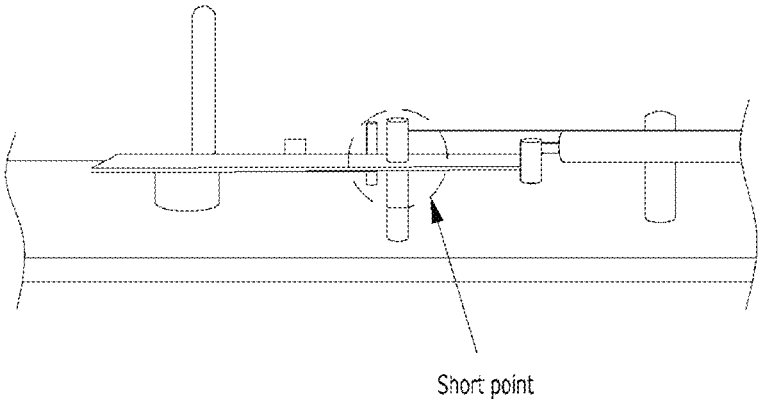

FIG. 5D is a side view of the substrate according to FIG. 5C. In detail, FIG. 5D shows the short point.

Figure 6A:
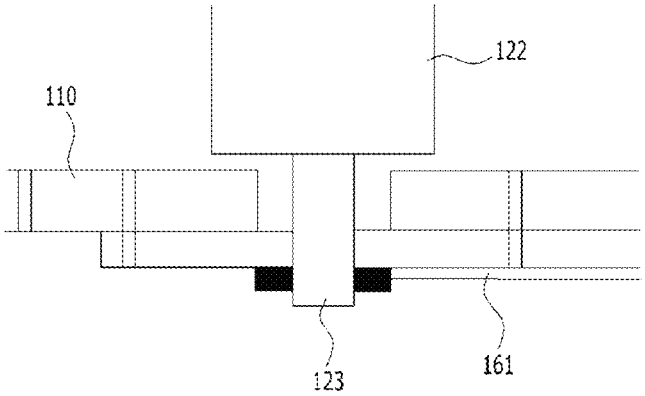
FIGS. 6A to 6B are views illustrating the configuration in which the band radiation element included in the base station antenna of the present invention is not electrically connected to a reflective plate.
Figure 6B:
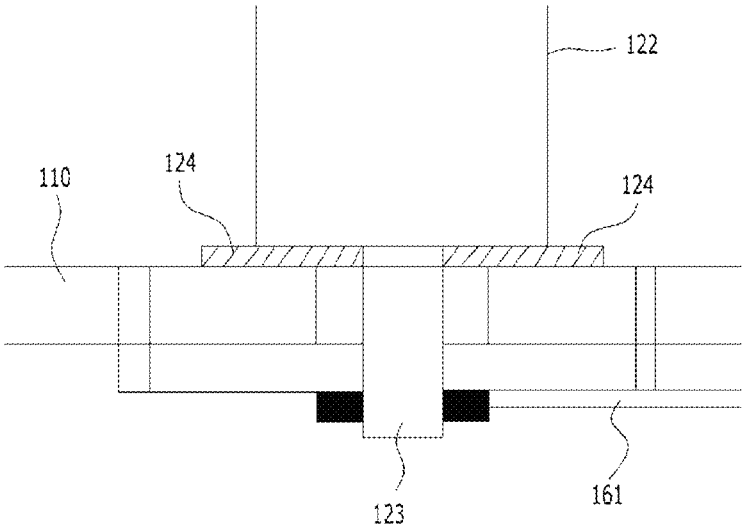

FIGS. 6A to 6B are views illustrating the configuration in which the band radiation element included in the base station antenna of the present invention is not electrically connected to a reflective plate.

In FIG. 6A, it can be seen that the first band radiation element support 122 is not directly connected to the reflective plate 110. The support lower end 123 and the signal line 161 may be connected to each other.

The base station antenna of the present invention according to FIG. 6B may further include a dielectric 124 disposed between the first band radiation element 120 and the reflective plate 110 to prevent the reflective plate from making direct electrical contact with the first band radiation element.

In addition, a second dielectric disposed between the second band radiation element and the reflective plate to prevent the reflective plate from making direct electrical contact with the second band radiation element may exist.

Figure 7A:
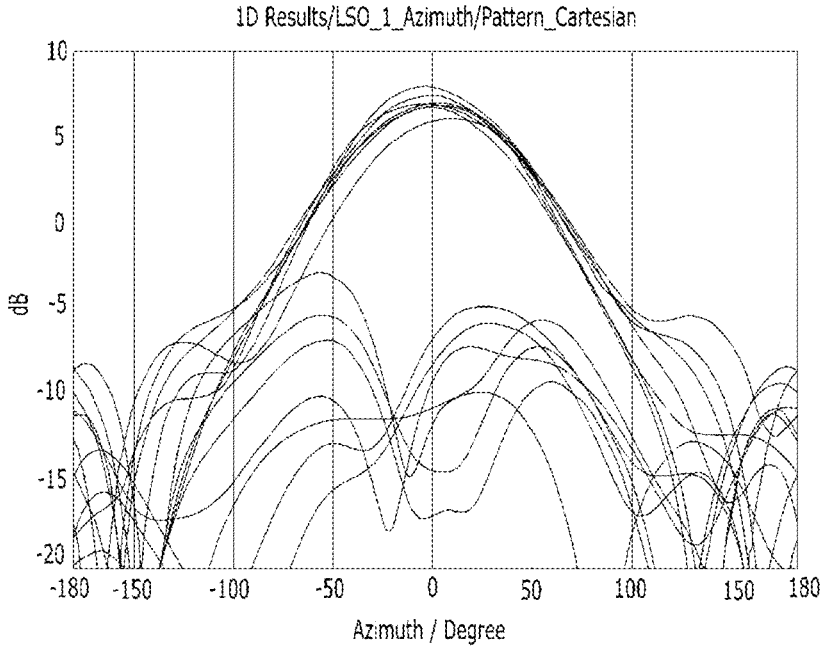
FIG. 7A is a graph illustrating the configuration of a beam pattern of the base station antenna of the related art.
Figure 7B:
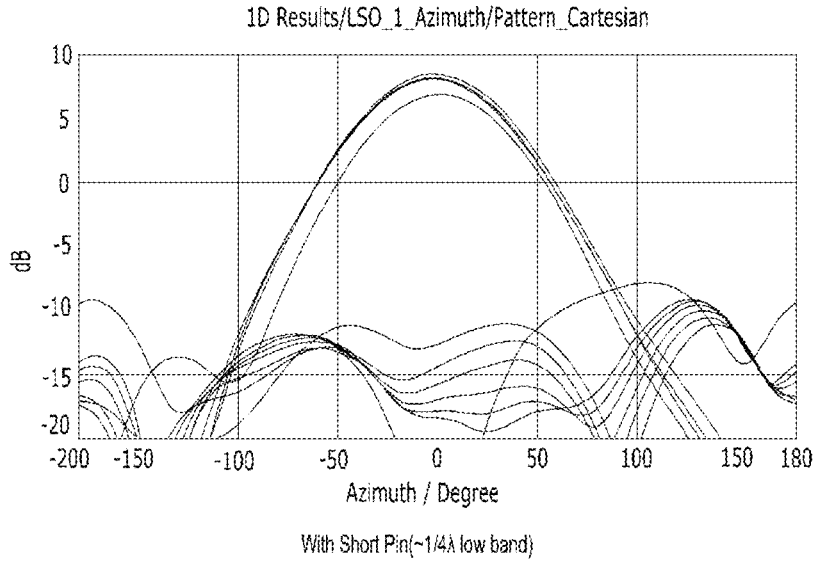
FIG. 7B is graph illustrating the configuration of a beam pattern of the base station antenna of the present invention.

FIG. 7A is a graph illustrating the configuration of a beam pattern of the base station antenna of the related art, and FIG. 7B is graph illustrating the configuration of a beam pattern of the base station antenna of the present invention. In addition, FIG. 8 is a graph showing a change in a beamwidth of the base station antenna of the present invention.

Figure 8:
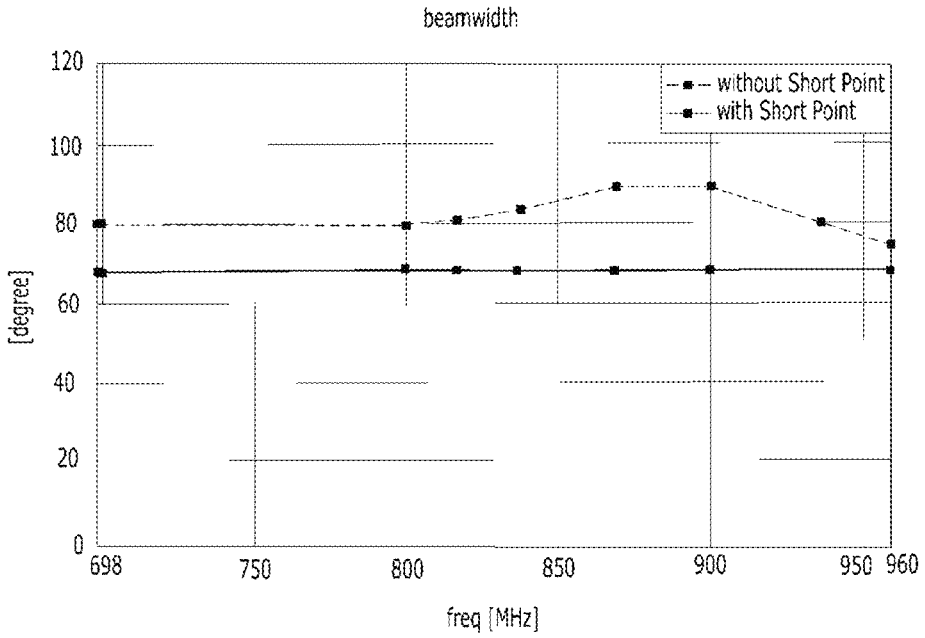
FIG. 8 is a graph showing a change in a beamwidth of the base station antenna of the present invention.

Referring to FIGS. 7A, 7B, and 8, as compared with the base station antenna of the related art, the base station antenna of the present invention is shorted with the reflective plate at the short point spaced apart by a preset interval, or the reflective plate is prevented from being electrically connected to the radiation element, so that distortion of the beamwidth may be reduced, and the antenna performance may be improved.

Referring to FIG. 7A, as the low frequency band radiation element and the high frequency band radiation element of the related art become close to each other, the interference may become severe, deviation of a pattern beamwidth may become large, and a cross-pol level may be degraded. FIG. 7B shows the pattern when the resonance does not occur, in which the beamwidth deviation is small, and the cross-pol level is improved.

Referring to FIG. 8, changes in a horizontal axis (frequency) and a vertical axis (beamwidth) are shown. Compared to the antenna of the related art which has a severe beamwidth deviation, the base station antenna of the present invention may have a constant beamwidth.

Figure 9:
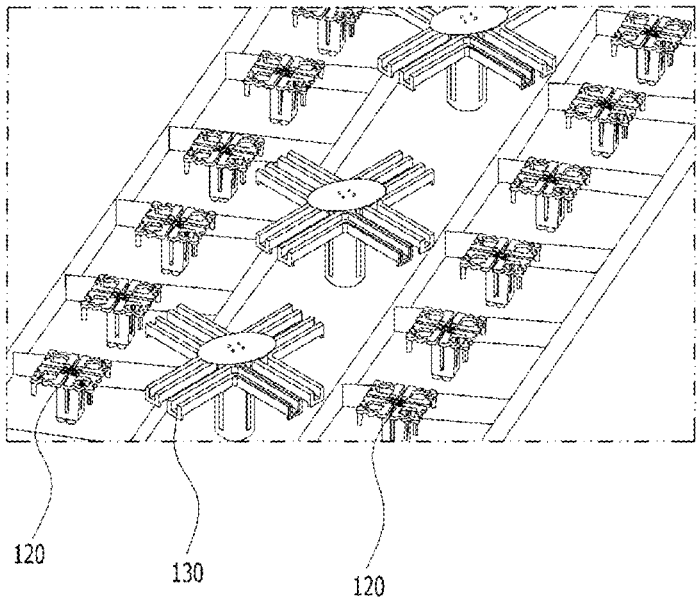
FIG. 9 is a view showing the base station antenna according to one embodiment of the present invention.

FIG. 9 is a view showing the base station antenna according to one embodiment of the present invention.

The base station antenna may include one or more first band radiation elements 120 arranged in two columns, and one or more second band radiation elements 130 arranged in one column which is disposed between the two columns.

The base station antenna may include one or more first band radiation elements 120 arranged in two columns, and one or more second band radiation elements 130 arranged in another column. As shown in FIG. 9, the column in which the one or more second band radiation elements 130 are arranged may be disposed between the two different columns in which the one or more first band radiation elements 120 are arranged.

As described above, the radiation elements of the base station antenna of the present invention may be arranged in arrays. When multiple radiation elements are arranged along specific positions, beam patterns of the radiation elements are combined to increase the radiation power, thereby creating a strong beam pattern that may be spread farther.

In addition, in the base station antenna of the present invention, the second band radiation elements 130 or the first band radiation elements 120 may be arranged in at least two columns. In particular, it is preferable to form three columns in which the second band radiation elements 130 are arranged in a center column, and the first band radiation elements 120 are arranged in both side columns.

Referring to the embodiment of arrays, the second band radiation element 130 may be disposed in the middle of four first band radiation elements 120.

In addition, referring to another embodiment, the second band radiation element 130 may be disposed in the same row as the first band radiation element 120. An antenna structure of the present invention may be variously arranged depending on the performance and characteristics of the antenna.

In this case, the first band radiation element 120 may be disposed in both side edge columns of the antenna, and the second band radiation element 130 may be disposed in a center column of the antenna. In particular, since the second band radiation element 130 is disposed in the center column among the three columns, the second band radiation element 130 may be disposed in the middle of adjacent first band radiation elements 120 disposed in the both side edge columns.

Figure 10:
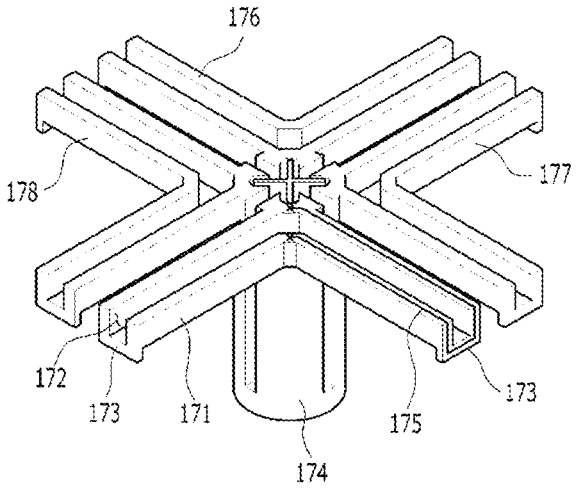
FIG. 10 is a perspective view showing a second band radiation element.

FIG. 10 is a perspective view showing a radiation element according to one embodiment.

The second band radiation element may include: a radiator; and a support 174 extending from a center of the radiator in a direction perpendicular to the radiator, wherein the radiator may include: a first arm 171 which extends while being curved at a specific angle, has a groove 172 formed from one end to an opposite end of the first arm 171, and includes a protrusion 173 protruding from the one end and the opposite end of the first arm 171; and a second arm 176 facing the first arm 171.

The radiator may include the first arm 171, the second arm 176, a third arm 177, and a fourth arm 178. In this case, the first arm 171 and the second arm 176 may face each other to constitute one dipole antenna. The third arm 177 and the fourth arm 178 may face each other to constitute another dipole antenna. As a result, the second band radiation element may have a structure in which two dipole antennas are combined.

As shown in FIG. 10, the first arm 171 and the second arm 176 may face each other, and the third arm 177 and the fourth arm 178 may face each other.

The radiator may include: the first arm 171 which extends while being curved at a specific angle, has the groove 172 formed from the one end to the opposite end of the first arm 171, and includes the protrusion 173 protruding from the one end and the opposite end of the first arm 171; and the second arm 176 facing the first arm 171. The first arm 171, the second arm 176, the third arm 177 and the fourth arm 178 may have the same shape.

The first arm 171 may extend while being curved at a specific angle, may have the groove 172 formed from the one end to the opposite end of the first arm 171, and may include the protrusion 173 protruding from the one end and the opposite end of the first arm 171. The specific angle may be 90 degrees. The first arm 171 may extend from the center of the radiator in a direction perpendicular to the radiator. The groove 172 may be formed from the one end to the opposite end of the first arm 171, and the first arm 171 may include the protrusion 173 protruding from the one end of the first arm 171 in a direction parallel to the support 174. The first arm 171 may include the protrusion 173 protruding from the opposite end of the first arm 171 in the direction parallel to the support 174.

The first band radiation element or the second band radiation element may include the support 174 extending from the center of the radiator in the direction perpendicular to the radiator. As shown in FIG. 10, the radiator and the support 174 of the second band radiation element may be perpendicular to each other.

In addition, FIG. 10 shows a radiator length L1. The radiator length L1 is a length of the path through which the current flows in the radiator, and corresponds to a length from one end to a center of the radiator. In other words, in the radiator, a current path 175 may have the radiator length L1 that corresponds to the length from the one end to the center of the radiator.

Figure 11:
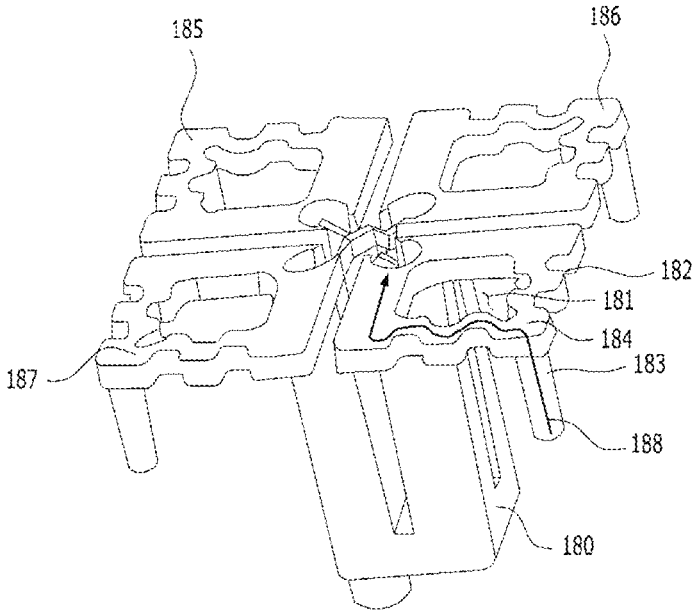
FIG. 11 is a perspective view showing a first band radiation element.

FIG. 11 is a perspective view showing a first band radiation element.

The first band radiation element may include: a radiator; and a support 180 extending from a center of the radiator in a direction perpendicular to the radiator, wherein the radiator may include: a fifth arm 184 including a hole 181 formed at a center portion thereof, a concavo-convex part 182 formed at a part of an edge thereof, and a droop 183 extending in parallel with the support 180; and a sixth arm 185 facing the fifth arm 184.

As shown in FIG. 11, the fifth arm 184 and the sixth arm 185 may face each other, and a seventh arm 186 and an eighth arm 187 may face each other. The fifth to eighth arms 184, 185, 186, and 187 may have the same shape.

The fifth arm 184 may include the hole 181 formed at the center portion of the fifth arm 184, the concavo-convex part 182 formed at a part of the edge of the fifth arm 184, and the droop 183 extending in parallel with the support 180. The shape of the hole 181 is not limited to the shape shown in FIG. 11. Concavo-convex portions may be formed in a part of an edge of the hole 181.

The concavo-convex part 182 may be formed at a part of the edge of the fifth arm 184, and the concavo-convex part 182 may be formed in a direction perpendicular to the support 180. The concavo-convex part 182 is a shaded portion in FIG. 11.

The droop 183 may extend in parallel with the support, and may be disposed at one end of the fifth arm 184. Since the droop 183 extends in parallel on the fifth arm 184, an area of one section of the droop 183 may be gradually narrowed.

In addition, FIG. 11 shows the radiator length L1. The radiator length L1 is the length of the path through which the current flows in the radiator, and corresponds to the length from the one end to the center of the radiator. In other words, in the radiator, a current path 188 may have the radiator length L1 that corresponds to the length from the one end to the center of the radiator.

The embodiments of the present invention described above are disclosed for illustrative purposes, and the present invention is not limited to the embodiments. In addition, it will be understood by those of ordinary skill in the art to which the present invention pertains that various changes and modifications can be made without departing from the spirit and scope of the present invention, and such changes and modifications shall be construed as falling within the scope of the present invention.

The invention claimed is:

1. A base station antenna comprising:

a reflective plate;

at least one first band radiation element disposed on a top surface of the reflective plate and having a first wavelength (λH); and at least one second band radiation element disposed on the top surface of the reflective plate and having a second wavelength (λL), wherein the first band radiation element is not directly connected to the reflective plate, the first band radiation element includes a first band radiation element support, a support lower end of the first band radiation element is connected to a power feed line on the reflective plate, the power feed line is shorted with the reflective plate at a short point spaced apart from the first band radiation element by a preset interval, and wherein a short part protruding from the reflective plate is shorted with the power feed line at the short point, and the short part includes a conductor.

2. A base station antenna comprising:

a reflective plate;

at least one first band radiation element disposed on a top surface of the reflective plate and having a first wavelength (λH); and at least one second band radiation element disposed on the top surface of the reflective plate and having a second wavelength (λL), wherein the first band radiation element is not directly connected to the reflective plate, the first band radiation element includes a first band radiation element support, a support lower end of the first band radiation element is connected to a power feed line on the reflective plate, the power feed line is shorted with the reflective plate at a short point spaced apart from the first band radiation element by a preset interval, wherein the short point is spaced apart from the support lower end of the first band radiation element by a short point length ($L_S$), and the short point length ($L_S$) is represented by $L_S=\lambda_L/4-L^1/2-H^1$ ($L^1$: radiator length, $H^1$: height of the first band radiation element support).

3. The base station antenna of claim 1, wherein the power feed line includes a coaxial cable or a transmission line on a PCB substrate.

4. The base station antenna of claim 3, wherein, when the power feed line includes the coaxial cable, an outer conductor of the coaxial cable makes contact with the reflective plate at the short point.

5. The base station antenna of claim 1, further comprising a first dielectric disposed between the first band radiation element and the reflective plate to prevent the reflective plate from making direct electrical contact with the first band radiation element.

6. A base station antenna comprising:

a reflective plate;

at least one first band radiation element disposed on a top surface of the reflective plate and having a first wavelength (λH); and at least one second band radiation element disposed on the top surface of the reflective plate and having a second wavelength (λL), wherein the first band radiation element is not directly connected to the reflective plate, the first band radiation element includes a first band radiation element support, a support lower end of the first band radiation element is connected to a power feed line on the reflective plate, the power feed line is shorted with the reflective plate at a short point spaced apart from the first band radiation element by a preset interval, wherein the second band radiation element includes:

a radiator; and support extending from a center of the radiator in a direction perpendicular to the radiator, and the radiator includes:

a first arm which extends while being curved at a specific angle, has a groove formed from one end to an opposite end of the first arm, and includes a protrusion protruding from the one end and the opposite end of the first arm; and a second arm facing the first arm.

7. The base station antenna of claim 1, wherein one or more first band radiation elements are arranged in two columns; and one or more second band radiation elements are arranged in one column which is disposed between the two columns.

* * * * *